United States Patent [19]

Kakehashi

[11] 4,205,579

[45] Jun. 3, 1980

[54] DEVICE FOR PRODUCING CHORUS EFFECTS

[75] Inventor: Ikutaro Kakehashi, Osaka, Japan

[73] Assignee: Roland Corporation, Osaka, Japan

[21] Appl. No.: 915,305

[22] Filed: Jun. 12, 1978

Related U.S. Application Data

[63] Continuation of Ser. No. 663,226, Mar. 3, 1976, abandoned.

[51] Int. Cl.[2] ..... G10H 1/04

[52] U.S. Cl. ..... 84/1.24; 84/1.25; 84/DIG. 4

[58] Field of Search ..... 84/1.24, 1.25, DIG. 4; 332/16 R, 16 T, 17, 22; 331/47, 49

[56] References Cited

U.S. PATENT DOCUMENTS

| | | | |
|---|---|---|---|
| 3,467,759 | 9/1979 | Campbell | 84/1.25 |
| 3,535,431 | 10/1970 | Szabo | 84/1.11 |
| 3,711,620 | 1/1973 | Kameoka et al. | 84/1.24 |
| 3,719,782 | 3/1973 | Barnum | 84/1.24 |
| 3,748,598 | 7/1973 | Munch et al. | 84/1.24 X |
| 3,762,265 | 10/1973 | Adachi | 84/1.24 |
| 3,833,752 | 9/1974 | Van der Kooij | 84/1.24 |
| 3,838,202 | 9/1974 | Nakada | 84/1.24 |
| 3,866,505 | 2/1975 | Adachi | 84/1.24 |
| 4,000,676 | 1/1977 | Love | 84/1.25 |
| 4,008,641 | 2/1977 | Takada et al. | 84/1.24 |
| 4,043,243 | 8/1977 | Peterson | 84/1.25 |
| 4,072,079 | 2/1978 | Sharp | 84/1.25 |
| 4,078,466 | 3/1978 | Suenaga et al. | 84/1.25 |
| 4,144,790 | 3/1979 | Suchoff | 84/DIG. 4 |

*Primary Examiner*—J. V. Truhe

*Attorney, Agent, or Firm*—Wenderoth, Lind & Ponack

[57] ABSTRACT

A device for producing a chorus effect for an electronic musical instrument. The device has two sets of parallel time delay modulating circuits with each set having two circuits therein and the circuits being adapted to have the musical tones from the electronic musical instrument supplied thereto. Saw-tooth wave generators are coupled to the respective time delay modulating circuits for supplying the respective time delay circuits in each set with a saw-tooth modulating wave having a gradually increasing slope and a sharply decreasing slope, the saw-tooth wave supplied to one circuit in the set having the gradual slope increasing in the positive direction and the saw-tooth wave supplied to the other circuit in the set having the gradual slope increasing in the negative direction so that the waves in the set have opposite polarities, and the saw-tooth waves for one set of modulating circuits being 180° out of phase with the saw-tooth waves for the other set of time delay modulating circuits. A plurality of amplitude modulating circuits are provided, one coupled to each of the time delay modulating circuits, and modulating wave generators are coupled to the amplitude modulating circuits for supplying modulating waves to the amplitude modulating circuits for making the output from the respective time delay modulating circuits a minimum when the direction of the saw-tooth waves for the corresponding time delayed modulating circuits is sharply decreasing. Mixing means mixes the outputs of the amplitude modulating circuits.

3 Claims, 2 Drawing Figures

GS
Ta
Ta

A′
Tb

B′
Ta

C′
Tb

D′

WX′

YZ′

AGS′

CGS

BGS

DGS
t0
t1
t2
t3
t4
t5
TIME

DEVICE FOR PRODUCING CHORUS EFFECTS

This is a continuation of application Ser. No. 663,226, filed Mar. 3, 1976, now abandoned.

This invention relates to a device for producing chorus effects in an electronic musical instrument.

BACKGROUND OF INVENTION AND PRIOR ART

In the prior art systems for producing chorus effects from musical tone signals, the method generally followed is one in which the musical tone signal input is time delay modulated by means of a plurality of sinusoidal modulating signals having uniform phase differences to produce musical tone signals continuously varying in the frequency upwards and downwards from the frequency of the original tone signals, and mixing the original and modulated tone signals together.

However, because the time delay modulated musical tone signals, even with a low modulation frequency of 0.2–1 c/s are influenced by a vibrato effect and the phase difference between the modulated signals, is uniform, a substantial chorus effect may be heard but the feeling of vibrato is not completely cancelled, so that an adequate chorus effect is not achieved.

OBJECT AND BRIEF SUMMARY OF THE INVENTION

It is the object of this invention to provide a device which will produce an ideal chorus effect from an electronic musical instrument without the introduction of a vibrato effect.

These objects are achieved by a device for producing chorus effects for an electronic musical instrument according to the present invention in which there is provided at least two sets of time delay modulating circuits, into which musical tones are introduced, and means for generating two sets of saw-tooth waves differing from each other in phase by 180°. The saw-tooth waves in each set have opposite polarities and are used as the time delay modulating signals and are connected to the respective time delay modulating circuits. An amplitude modulating circuit is coupled to each of the time delay modulating circuits for amplitude modulation of the two sets of output musical tone signals from the time delay modulating circuits. Means for generating sinusoidal or triangular modulating waves are coupled to the amplitude modulating circuits for making the output from the time delay modulating circuits a minimum for the interval during which the direction of modulation of the saw-tooth time delay modulating signal is suddenly varied. Mixing means mixes the modulating tone signals to form a second musical tone signal, the frequency of which has been deviated in a predetermined direction from that of the original musical tone signal. The mixing means combines the modulated tone signals in a manner so that each of the tone signals compensates for the trough of the envelope of the modulated amplitude of the other tone signal. Finally, the original musical tone signal and the second musical tone signal are electrically or acoustically combined to attain a chorus effect.

BRIEF DESCRIPTION OF THE DRAWINGS

The invention will now be explained in greater detail in connection with the accompanying drawings, in which.

DETAILED DESCRIPTION OF THE INVENTION

Figure 1:
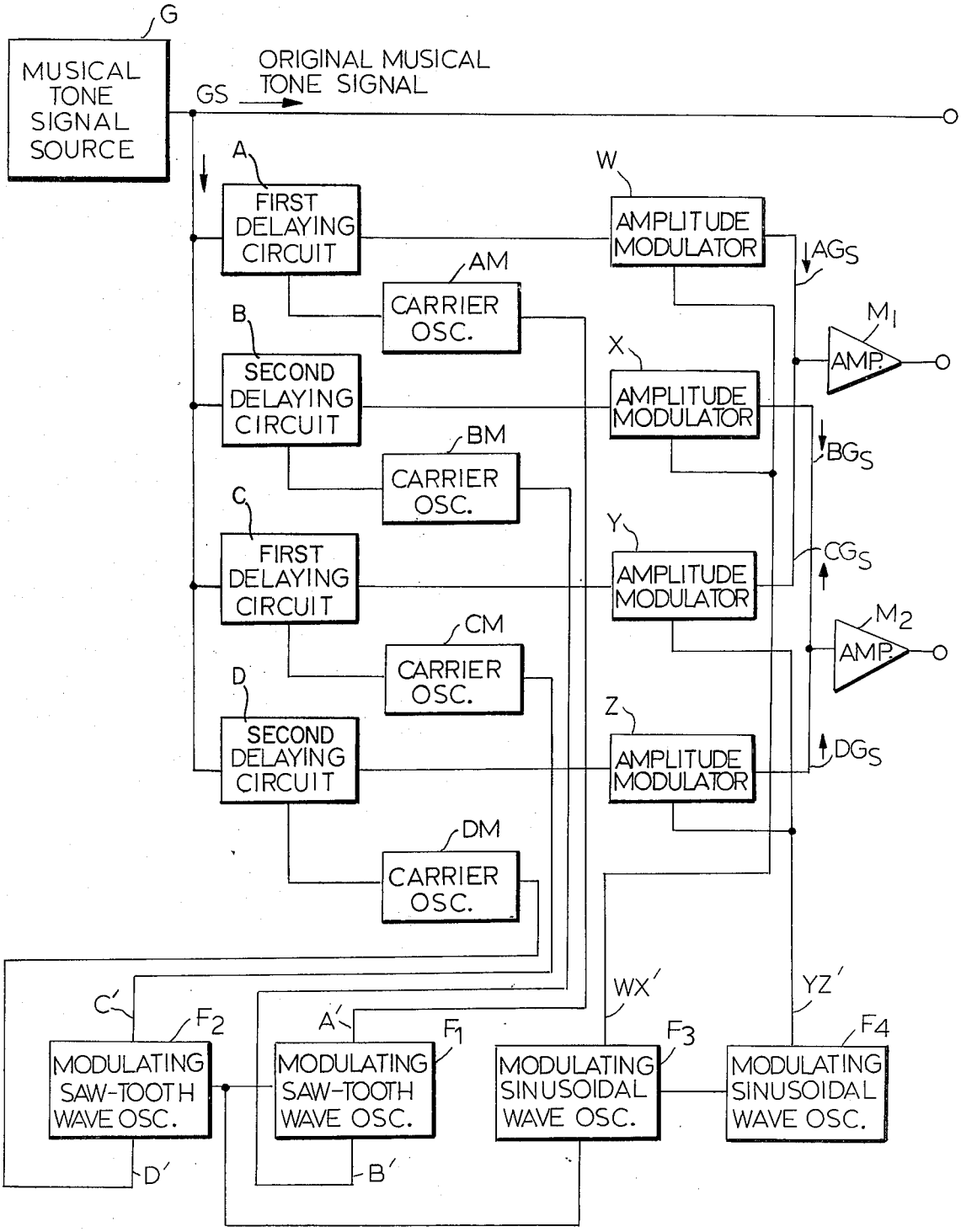
FIG. 1 is a circuit diagram of one embodiment of the device for producing a chorus effect according to this invention.
Figure 2:
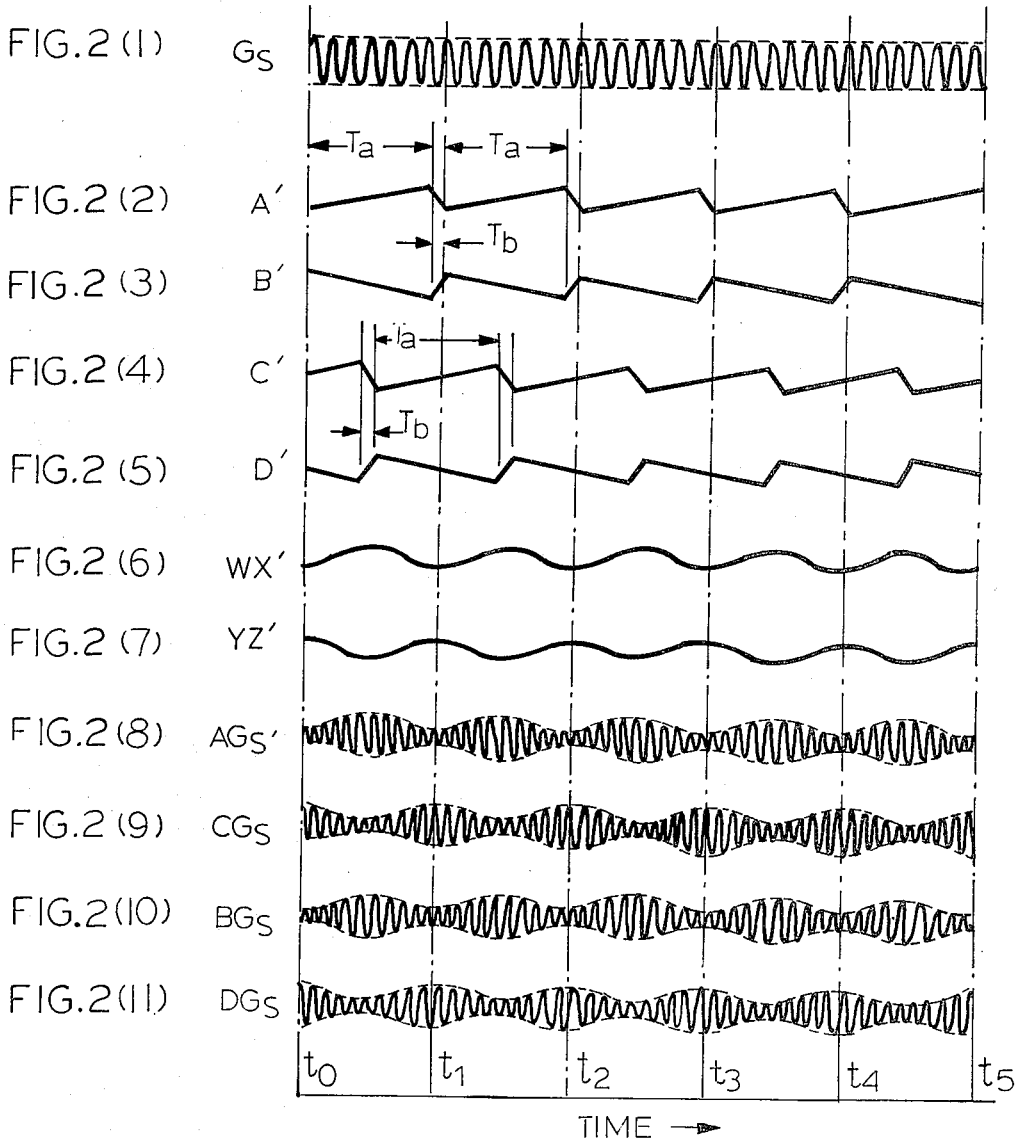
FIGS. 2(1)–2(11) are diagrammatic representations of wave forms of various signals at points in the circuit of FIG. 1.

Referring to FIG. 1, there is shown an embodiment which has four channels each having time delay modulating means therein. An output musical tone signal having the waveform as shown in FIG. 2 (1), is supplied to two sets of time delay modulating elements, set A and B and set C and D each set having a pair of electronic delaying circuits. These delay circuits, which can be conventional bucket brigade circuits or charge coupled devices, act to cause the input musical tone signal Gs to be time delayed according to the modulating signal supplied thereto through respective carrier oscillators, AM, BM, CM and DM connected thereto which comprise voltage controlled oscillators, whereby the musical tone signal is frequency-modulated in each delay circuit. The output musical tones are delivered to the amplitude modulators W, X, Y and Z. The control signal for one set of voltage controlled carrier oscillators AM and BM are supplied from a first saw-tooth wave oscillator F1, and those for the other set of voltage controlled carrier oscillators CM and DM are supplied from saw-tooth wave oscillator F2.

The means for providing the modulated time delay in the prior art systems is ordinarily a bucket brigade device drawn by a voltage controlled oscillator. The bucket brigade device stores samples of the input musical tone signal in each of a plurality of storage elements. In accordance with the frequency of the signal produced by the voltage controlled oscillator the sampling rate and the storage time in each of the plurality of storage elements may be controlled. A higher frequency from the voltage controlled oscillator is associated with a higher sampling rate and a shorter time each sample is stored in the storage elements. Since the number of storage elements in the bucket brigade device is fixed, this leads to a short time delay. On the other hand, if the voltage controlled oscillator is producing a signal at a lower frequency the sampling rate is lower, each sample spends a longer period of time in each respective storage element and the time delay produced by the device is longer. Thus, the time delay produced by this bucket brigade device is controlled by the frequency of the voltage controlled oscillator. Similarly, a signal applied to the input of the voltage controlled oscillator controls the frequency produced by that oscillator. When the voltage controlled oscillator is driven by a sinusoidal signal, the time delay produced by the time delay device is sinusoidal and the frequency of the musical tone output from the time delay device has a frequency which varies in proportion to the sinusoidal input to the voltage controlled oscillator. According to the present invention as explained in detail below, the voltage controlled oscillators are driven by saw-tooth wave signals.

The function performed by the delay circuit will now be described: If the output signals from the carrier oscillators AM, BM, CM, and DM are frequency modulated by the output modulating waves A′, B′, C′ and D′, respectively, from the saw-tooth wave oscillators F1 and F2, the wave-forms of which are shown in FIGS. 2

(2)-2 (5), the frequencies of the output musical tone signals from the delay elements A, B, C and D will be caused to deviate from the frequency of the input musical tone signal Gs in accordance with the gradual slope of the wave-form of the modulating waves A', B' C' and D' for the interval Ta towards a frequency level slightly higher, in the modulating elements A and C, or towards a frequency level slightly lower, in the modulating elements B and D, than that of the original musical tone signal Gs. For the interval Tb, during which the modulating waves move along a steep slope in the opposite direction, the output musical tone signals will be caused to deviate instantly in reverse. When the modulating signal having the gradual slope is restored, the frequency of the output musical tone signal will again be caused to deviate towards a frequency level slightly higher or slightly lower than the original musical tone signal Gs.

That is to say, the frequency of the output musical tone signal from the delay circuit A, which is supplied with a time delay modulating signal from the carrier oscillator AM, the output of which is frequency modulated by means of the modulating wave A' shown in FIG. 2 (2), from the saw-tooth wave oscillator F1, will be caused to deviate from the frequency of the original musical tone Gs in accordance with the gradual slope of the modulating wave A' during the interval Ta towards a frequency level slightly higher than that of the original musical tone signal Gs, and during the interval Tb, during which the slope is much steeper but slanted in the opposite direction, will be caused to deviate toward a frequency level slightly lower than that of the original musical tone signal. If the gradual first slope is restored, then the output tone signal with a frequency level slightly higher than that of the original musical tone will be produced during the interval Ta. The above described changes are repeated cyclically according to the saw-tooth waveform A'.

The musical tone signal produced by the delay circuit B is a mirror image of that produced by the delay circuit A and is caused to deviate by modulating wave B', shown in FIG. 2 (3), to a frequency level slightly lower than that of the original musical tone Gs during time interval Ta and during the interval Tb the frequency is instantly caused to deviate in a direction towards a frequency level higher than that of the original musical tone Gs. Likewise, if the gradual slope of the modulating signal during time Ta is restored, the frequency will again return to the level lower than that of the original musical tone signal Gs. These changes are repeated cyclically.

As for the delaying circuits C and D, the modulating waves C' and D' (shown in FIGS. 2 (4)) are 2 (5) and 180° out of phase with the modulating waves A' and B', but otherwise they act on the delay circuits C and D the same as modulating waves A' and B' act on delay circuits A and B.

Thus the frequency levels of the output musical tone signals from the delay circuits A, B, C and D, respectively, are slightly shifted toward a higher frequency or toward a lower frequency as compared to the frequency level of the respective original musical tone signals, and they are then delivered to the respective amplitude modulators W, X, Y and Z.

The modulating sinusoidal wave oscillators F3 and F4, are coupled with the amplitude modulators W, X, Y and Z and are synchronized with the modulating saw-tooth wave oscillators F1 and F2. The phase relationships between the output modulating waves WX' and YZ' from oscillators F3 and F4 and the saw-tooth waves A' and C' are set as shown in FIGS. 2 (6) and 2 (2), and 2 (7) and 2 (4), respectively. The interval during which the frequencies of the output musical tones of the delay circuits A, B, C and D are suddenly varied, i.e. the time period Tb in the waveforms of the modulating waves A', B', C', and D', coincides with the lowest points of the amplitudes of the modulating waves WX' and YZ', respectively, accordingly, the wave-forms of the output musical tone signals AGs, BGs, CGs and DGs from the amplitude modulators W, X, Y and Z, respectively, will be as shown in FIGS. 2 (8), 2 (10), 2 (9), and 2 (11), respectively. The output musical tone signals AGs and CGs have the frequencies slightly shifted toward levels higher than that of the input original musical tone signals and are amplitude modulated, and output musical tone signals BGs and DGs have the frequencies slightly shifted toward levels lower than that of the input original musical tone signals and are amplitude modulated.

The pairs of output musical tone signals which have the frequency shifted in the same direction are respectively mixed in amplifiers M1 and M2 in combinations AGs+CGs and BGs+DGs, respectively. The lowered amplitude portion of the envelope of each amplitude modulated waveform in a pair is filled by the highest amplitude portion of the envelope of the other waveform, to produce two output musical tone signals, having a constant amplitude, the frequency of the one deviating slightly towards a higher frequency level and that of the other deviating slightly towards a lower level relative to the frequency of the original musical tone signal. Therefore, if the two combined waves are amplified through the amplifiers M1 and M2, respectively, and are mixed with the original input tone signal GS by electrical or acoustical means, than an adequate chorus effect will be created without any impression of vibrato.

Instead of mixing the output musical tones in the combinations AGs+CGs and BGs+DGs, as in the foregoing example, other combinations, wherein the output musical tones are mixed in combinations such as AGs+DGs and CGs+BGs, can be made before mixing the modulated signals with the original input musical tone signal Gs to attain the same result.

Further, if the amplitude or frequency of the output modulating waves A', B', C' and D' of the abovesaid saw-tooth wave oscillators F1 and F2, is changed without the phase relationship to the output modulating waves WX' and YZ' from oscillators F3 and F4 being changed then the rate of change of the delay time is varied and the amount of deviation of the frequency from that of the original tone signal is varied and a different concert effect can be attained.

In the foregoing embodiment having four channels with time delay elements therein, there has been described a method whereby two sets of combined signals which are respectively higher and lower than the original musical tone signal are added to the original musical tone signal to attain a concert effect. However, a concert effect of two musical tones can also be obtained by combining the original musical tone signal with a musical tone signal which is either higher or lower than the original tone and which can be produced by a two channel circuit having time delay elements therein. In the embodiment described with reference to FIG. 1, there are obtained four modulated waves, A' and B', and C' and D', the waves of each pair being symmetrically modulated in directions opposite to each other from the same saw-tooth wave oscillators F1 and F2. However, if modulating waves A′ and B′ are maintained 180° out of phase with waves C′ and D′, any one of the modulating waves can be supplied from the oscillator independent of each other and the same effect can be produced.

Further, even if any other waveform is employed, for example, a triangular wave instead of a sinusoidal wave, for amplitude modulation as described above, a very similar effect is obtained as long as the amplitude is kept low during the period Tb of the corresponding saw-tooth wave and the amplitude of the combined musical tone signals is relatively constant.

What is claimed is:

1. A device for producing a chorus effect for an electronic musical instrument comprising:

at least one set of first and second time delay modulating means, each time delay modulating means having a signal output and a musical tone input adopted to have musical tones from said electronic musical instrument applied thereto and a delay time control input, for producing a delay in the signal applied to said musical tone input inversely proportional to the frequency of the signal applied to said delay time control input;

a plurality of voltage controlled oscillator means, one associated with each of said time delay modulating means, each having a control voltage input and having an output connected to said delay time control input of said associated time delay modulating means, for producing a signal whose frequency is proportional to the amplitude of the signal applied to said control voltage input;

a saw-tooth wave oscillator means associated with each set of time delay modulating means, having a first output connected to the control voltage input of said voltage controlled oscillator means associated with said first time delay modulating means and a second output connected to the control voltage input of said voltage controlled oscillator means associated with said second time delay modulating means, for producing a saw-tooth wave having a gradually increasing slope and a sharply decreasing slope, said saw-tooth wave produced by said first output having said gradually increasing slope in the positive direction and said saw-tooth wave produced by said second output having said gradually increasing slope in the negative direction;

a plurality of amplitude modulating means, one associated with each of said time delay modulating means, each having an amplitude modulator input connected to the signal output of said associated time delay modulating means and having an amplitude control input to which is applied a control signal, for controlling the amplitude of the signal applied to said amplitude modulator input in proportion to the amplitude of the control signal applied to said amplitude control input;

a plurality of modulating wave generator means, one associated with each of said amplitude modulating means, connected to an output of said saw-tooth wave oscillator means, for producing a control signal for application to said amplitude control input of said associated amplitude modulating means, said control signal having a minimum amplitude during the sharply decreasing slope portion of said saw-tooth wave applied to said time delay modulating means associated with said associated amplitude modulating means; and a mixing means connected to said amplitude modulating means for mixing the ouput of said amplitude modulating means.

2. A device for producing a chorus effect for an electronic musical instrument as claimed in claim 1, wherein:

said at least one set of time delay modulating means comprises a first set and a second set;

said saw-tooth wave oscillator means comprises a first saw-tooth wave oscillator means associated with said first set of time delay modulating means and a second saw-tooth wave oscillator means associated with said second set of time delay modulating means, said second saw-tooth wave oscillator means connected to said first saw-tooth wave oscillator means for producing said saw-tooth wave 180° out of phase with said saw-tooth wave produced by said first saw-tooth wave oscillator.

3. A device for producing a chorus effect for an electronic musical instrument as claimed in claim 2, wherein:

said mixing means comprises a first mixing amplifier connected to said amplitude modulating means associated with said first time delay modulation means of each of said first and second sets for mixing the outputs thereof and a second mixing amplifier connected to said amplitude modulating means associated with said second time delay modulating means of each of said first and second sets for mixing the outputs thereof.

* * * * *